US010389030B2

(12) United States Patent
Hsu et al.

(10) Patent No.: US 10,389,030 B2
(45) Date of Patent: Aug. 20, 2019

(54) ANTENNA STRUCTURE

(71) Applicant: Chiun Mai Communication Systems, Inc., New Taipei (TW)

(72) Inventors: Cho-Kang Hsu, New Taipei (TW); Te-Chang Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 52 days.

(21) Appl. No.: 15/684,853

(22) Filed: Aug. 23, 2017

(65) Prior Publication Data

US 2018/0062267 A1 Mar. 1, 2018

(30) Foreign Application Priority Data

Aug. 31, 2016 (CN) ..... 2016 1 0774852

(51) Int. Cl.

| | |
|---|---|
| ***H01Q 1/48*** | (2006.01) |
| ***H01Q 9/14*** | (2006.01) |
| ***H01Q 9/42*** | (2006.01) |
| ***H01Q 5/378*** | (2015.01) |
| *H01Q 1/50* | (2006.01) |

(52) U.S. Cl.

CPC ..... *H01Q 9/14* (2013.01); *H01Q 5/378* (2015.01); *H01Q 9/42* (2013.01); *H01Q 1/48* (2013.01); *H01Q 1/50* (2013.01)

(58) Field of Classification Search

CPC H01Q 9/14; H01Q 9/42; H01Q 5/378; H01Q 1/50; H01Q 1/48

USPC ..... 343/845

See application file for complete search history.

(56) References Cited

U.S. PATENT DOCUMENTS

| | | | | |
|---|---|---|---|---|
| 6,798,388 | B2 * | 9/2004 | Mayer | H01Q 1/088 343/702 |
| 8,886,265 | B2 * | 11/2014 | Rofougaran | H01Q 5/00 455/575.7 |
| 9,070,980 | B2 * | 6/2015 | Asanuma | H01Q 7/00 |
| 9,774,074 | B2 * | 9/2017 | Tsai | H01Q 1/243 |
| 2011/0275333 | A1 | 11/2011 | Kim et al. | |
| 2013/0122828 | A1 | 5/2013 | Choi | |

FOREIGN PATENT DOCUMENTS

| | | |
|---|---|---|
| CN | 102856639 A | 1/2013 |
| CN | 204966672 U | 1/2016 |

* cited by examiner

*Primary Examiner* — Brian K Young
(74) *Attorney, Agent, or Firm* — ScienBiziP, P.C.

(57) ABSTRACT

An antenna structure includes a feed portion, a high-frequency radiating portion, a low-frequency radiating portion, an extension portion, and a switching unit. The high-frequency radiating portion is electrically connected to the feed portion. The low-frequency radiating portion is electrically connected to the high-frequency radiating portion. The extension portion is electrically connected to the feed portion and the high-frequency radiating portion. The switching unit is electrically connected to the extension portion to control the extension portion to be in one of an open-circuit state and a short-circuit state.

9 Claims, 4 Drawing Sheets

ANTENNA STRUCTURE

CROSS-REFERENCE TO RELATED APPLICATIONS

This application claims priority to Chinese Patent Application No. 201610774852.5 filed on Aug. 31, 2016, and the contents of which are incorporated by reference herein.

FIELD

The subject matter herein generally relates to an antenna structure with a wide low frequency band.

BACKGROUND

Antennas are important elements in wireless communication devices, such as mobile phones and personal digital assistants. To communicate in multi-band communication systems, a bandwidth of an antenna in the wireless communication device needs to be wide enough to cover multiple frequency bands, especially a low frequency part needs to cover 700-900 MHz. In addition, because the wireless communication device trends to a maximization screen and a lightweight size, it is generally desirable to use one antenna to support all frequency bands to save cost. Therefore, how to use a single antenna structure to support all the frequency bands is an important topic of antenna design.

BRIEF DESCRIPTION OF THE DRAWINGS

Implementations of the present technology will now be described, by way of example only, with reference to the attached figures.

DETAILED DESCRIPTION

Figure 1:
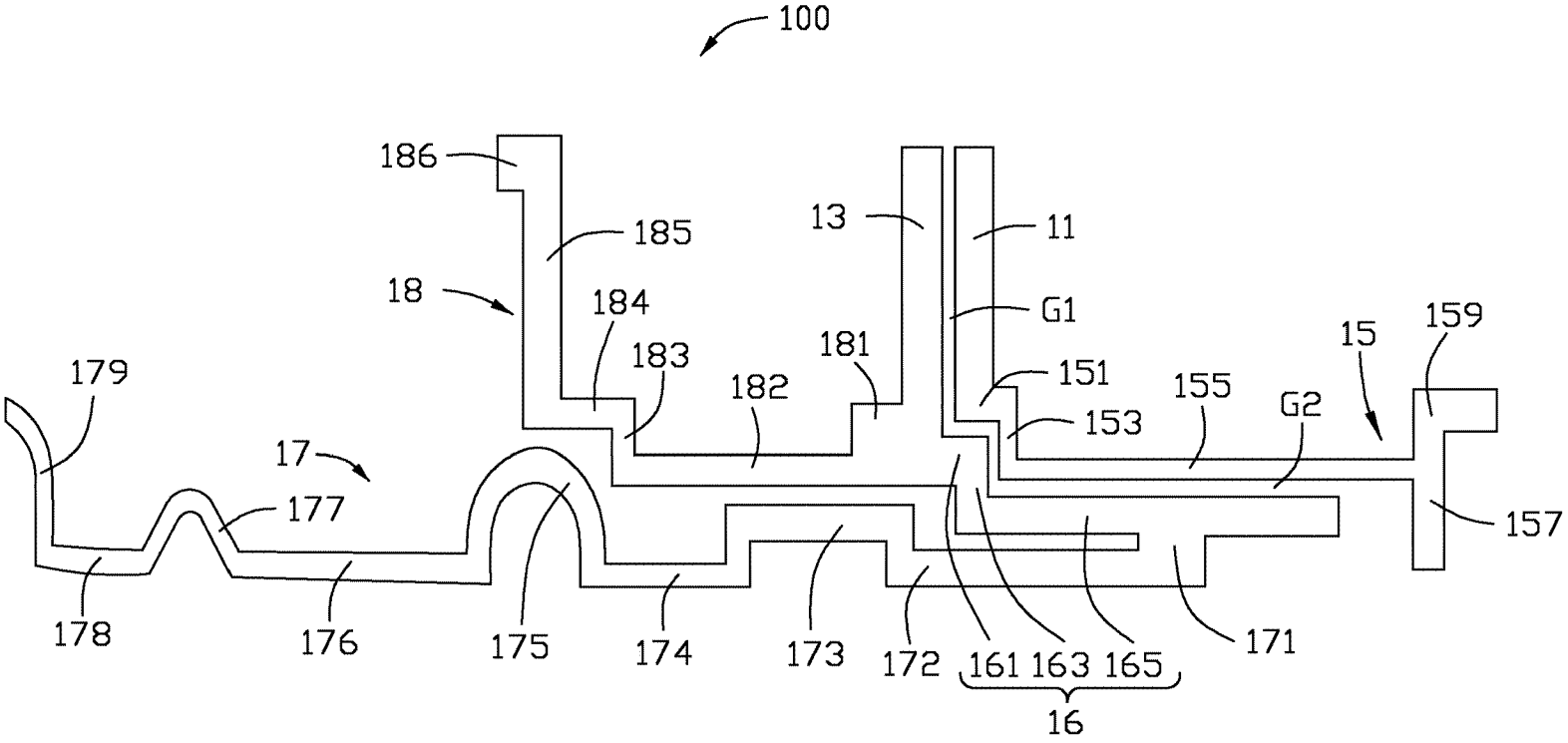
FIG. 1 is an isometric view of an exemplary embodiment of an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure.

FIG. 1 illustrates an embodiment of an antenna structure 100 applied to a wireless communication device (not explicitly shown). The wireless communication device can be a mobile phone or a personal digital assistant, for example. The antenna structure 100 can receive and transmit wireless signals.

The antenna structure 100 can be made of metallic sheet or flexible printed circuit (FPC). The antenna structure 100 can be attached to a plastic housing of the wireless communication device through an adhesive (e.g., glue or the like). The antenna structure 100 includes a ground portion 11, a feed portion 13, a high-frequency resonance portion 15, a high-frequency radiating portion 16, a low-frequency radiating portion 17, and an extension portion 18. The ground portion 11, the feed portion 13, the high-frequency resonance portion 15, the high-frequency radiating portion 16, the low-frequency radiating portion 17, and the extension portion 18 are all sheets and positioned on a same plane. That is, the ground portion 11, the feed portion 13, the high-frequency resonance portion 15, the high-frequency radiating portion 16, the low-frequency radiating portion 17, and the extension portion 18 are coplanar with each other.

In this exemplary embodiment, the ground portion 11 is substantially a strip. The ground portion 11 is electrically connected to a ground point (not shown) positioned on a printed circuit board (not shown) of the wireless communication device to ground the antenna structure 100.

The feed portion 13 is substantially a strip. In this exemplary embodiment, the feed portion 13 is spaced apart from and parallel to the ground portion 11. Then, a first gap G1 is defined between the feed portion 13 and the ground portion 11. The feed portion 13 is electrically connected to a signal feed point (not shown) positioned on the printed circuit board of the wireless communication device to provide current signals to the antenna structure 100.

In this exemplary embodiment, the high-frequency resonance portion 15 is electrically connected to the ground portion 11. The high-frequency resonance portion 15 includes a first resonance section 151, a second resonance section 153, a third resonance section 155, a fourth resonance section 157, and a fifth resonance section 159.

The first resonance section 151 is substantially a strip. The first resonance section 151 is perpendicularly connected to one end of the ground portion 11 and extends away from the feed portion 13.

The second resonance section 153 is substantially a strip. The second resonance section 153 is perpendicularly connected to the end of the first resonance section 151 away from the ground portion 11 and extends along a direction parallel to and away from the ground portion 11. The first resonance section 151 and the second resonance section 153 cooperatively form an L-shaped structure.

The third resonance section 155 is substantially a strip. The third resonance section 155 is perpendicularly connected to the end of the second resonance section 153 away from the first resonance section 151 and extends along a direction parallel to the first resonance section 151 and away from the ground portion 11. The first resonance section 151 and the third resonance section 155 are perpendicularly connected to two ends of the second resonance section 153 respectively, and extend along two directions parallel to and away from each other.

The fourth resonance section 157 is substantially a strip. The fourth resonance section 157 is perpendicularly connected to the end of the third resonance section 155 away from the second resonance section 153 and extends along a direction parallel to the second resonance section 153 and away from the ground portion 11. The fifth resonance section 159 is substantially L-shaped.

The fifth resonance section 159 and the fourth resonance section 157 are positioned at a same side of the third resonance section 155. One end of the fifth resonance section 159 is perpendicularly connected to a junction of the third resonance section 155 and the fourth resonance section 157. Another end of the fifth resonance section 159 extends along a direction parallel to the second resonance section 153 and away from the fourth resonance section 157, then extends along a direction parallel to the first resonance section 151 and away from the ground portion 11.

The high-frequency radiating portion 16 is electrically connected to the feed portion 13 and spaced apart from the high-frequency resonance portion 15. Then a second gap G2 is defined between the high-frequency radiating portion 16 and the high-frequency resonance portion 15. In this exemplary embodiment, the second gap G2 is in communication with the first gap G1. A width of the second gap G2 is about 0.5 mm. The high-frequency radiating portion 16 includes a first radiating section 161, a second radiating section 163, and a third radiating section 165 connected in that order.

The first radiating section 161 is substantially rectangular. The first radiating section 161 is perpendicularly connected to the end of the feed portion 13 adjacent to the first resonance section 151 and extends along a direction parallel to the first resonance section 151 towards the ground portion 11. The second radiating section 163 is substantially a strip. The second radiating section 163 is perpendicularly connected to the end of the first radiating section 161 away from the feed portion 13 and extends along a direction parallel to the second resonance section 153 and away from the feed portion 13. The third radiating section 165 is substantially a strip. The third radiating section 165 is perpendicularly connected to the end of the second radiating section 163 away from the first radiating section 161 and extends along a direction parallel to the first resonance section 151 and away from the feed portion 13. The first radiating section 161 and the third radiating section 165 are perpendicularly connected to two ends of the second radiating section 163 respectively, and extend along two directions parallel to and away from each other.

The low-frequency radiating portion 17 is substantially a meander sheet. The low-frequency radiating portion 17 is electrically connected to the high-frequency radiating portion 16. The low-frequency radiating portion 17 includes a first connecting section 171, a second connecting section 172, a third connecting section 173, a fourth connecting section 174, a fifth connecting section 175, a sixth connecting section 176, a seventh connecting section 177, an eighth connecting section 178, and a ninth connecting section 179 connected in that order.

The first connecting section 171 is substantially a strip. The first connecting section 171 is perpendicularly connected to a middle portion of the third radiating section 165 and extends along a direction parallel to the ground portion 11 and away from the high-frequency resonance portion 15.

The second connecting section 172 is substantially a strip. The second connecting section 172 is perpendicularly connected to the end of the first connecting section 171 away from the third radiating section 165 and extends along a direction parallel to the third radiating section 165 towards the feed portion 13. The extension continues until the second connecting section 172 passes beyond the feed portion 13.

The third connecting section 173 is substantially U-shaped. The third connecting section 173 is perpendicularly connected to the end of the second connecting section 172 away from the first connecting section 171 and extends along a direction parallel to and towards the feed portion 13. The third connecting section 173 then extends along a direction parallel to the second connecting section 172 and away from the feed portion 13, and then extends along a direction parallel to the first connecting section 171 and away from the feed portion 13.

The fourth connecting section 174 is substantially a strip. The fourth connecting section 174 is perpendicularly connected to the end of the third connecting section 173 away from the second connecting section 172 and extends along a direction parallel to the third radiating section 165 and away from the feed portion 13. The fifth connecting section 175 is substantially arched. The fifth connecting section 175 is electrically connected to the end of the fourth connecting section 174 away from the third connecting section 173.

The sixth connecting section 176 is substantially a strip. The sixth connecting section 176 is electrically connected to the end of the fifth connecting section 175 away from the fourth connecting section 174 and extends along a direction parallel to the third radiating section 165 and away from the feed portion 13. The seventh connecting section 177 is substantially arched. The seventh connecting section 177 is electrically connected to the end of the sixth connecting section 176 away from the fifth connecting section 175.

The eighth connecting section 178 is substantially a strip. The eighth connecting section 178 is electrically connected to the end of the seventh connecting section 177 away from the sixth connecting section 176 and extends along a direction parallel to the third radiating section 165 and away from the feed portion 13. The ninth connecting section 179 is substantially arc-shaped. The ninth connecting section 179 is perpendicularly connected to the end of the eighth connecting section 178 away from the seventh connecting section 177.

In this exemplary embodiment, the second connecting section 172, the fourth connecting section 174, the sixteen connecting section 176, and the eight connecting section 178 are substantially in a straight line. The first connecting section 171, the third connecting section 173, the fifth connecting section 175, the seventh connecting section 177, and the ninth connecting section 179 are all positioned on the same side of the straight line formed by the second connecting section 172, the fourth connecting section 174, the sixth connecting section 176, and the eight connecting section 178 adjacent to the feed portion 13.

In other exemplary embodiments, a specific structure of the low-frequency radiating portion 17 can also be adjustable according to elements on a carrier (e.g., a plastic housing) for holding the antenna structure 100.

The extension portion 18 is electrically connected to the feed portion 13 and the high-frequency radiating portion 16. The extension portion 18 is positioned on the side of the feed portion 13 away from the ground portion 11. The extension portion 18 is substantially a meander sheet. The extension portion 18 includes a first extension section 181, a second extension section 182, a third extension section 183, a fourth extension section 184, a fifth extension section 185, and a sixth extension section 186 connected in that order.

The first extension section 181 is substantially a strip. The first extension section 181 is perpendicularly connected to a junction of the feed portion 13 and the first radiating section 161 and extends along a direction parallel to the first resonance section 151 and away from the ground portion 11 and the feed portion 13. In this exemplary embodiment, the first extension section 181 and the first radiating section 161 are positioned at the end of the feed portion 13 adjacent to the first resonance section 151, and extend along two directions parallel to and away from each other. A width of the first extension section 181 is greater than a width of the first radiating section 161.

In this exemplary embodiment, a width of the second extension section 182 is less than the width of the first extension section 181. The second extension section 182 is electrically connected to the end of the first extension section 181 away from the feed portion 13 and extends along a direction parallel to the first resonance section 151 and away from the ground portion 11 and the feed portion 13.

The third extension section 183 is substantially a strip. The third extension section 183 is perpendicularly connected to the end of the second extension section 182 away from the first extension section 181 and extends along a direction parallel to the feed portion 13 and away from the low-frequency radiating portion 17. Then, the first extension section 181 and the third extension section 183 are positioned on the same side of the second extension section 182.

The fourth extension section 184 is substantially a strip. The fourth extension section 184 is perpendicularly connected to the end of the third extension section 183 away from the second extension section 182 and extends along a direction parallel to the second extension section 182 and away from the ground portion 11 and the feed portion 13.

The fifth extension section 185 is substantially a strip. The fifth extension section 185 is perpendicularly connected to the end of the fourth extension section 184 away from the third extension section 183 and extends along a direction parallel to the feed portion 13 and away from the low-frequency radiating portion 17. The sixth extension section 186 is substantially rectangular. The sixth extension section 186 is perpendicularly connected to the end of the fifth extension section 185 away from the fourth extension section 184 and extends along a direction parallel to the fourth extension section 184 and away from the feed portion 13.

Figure 2:
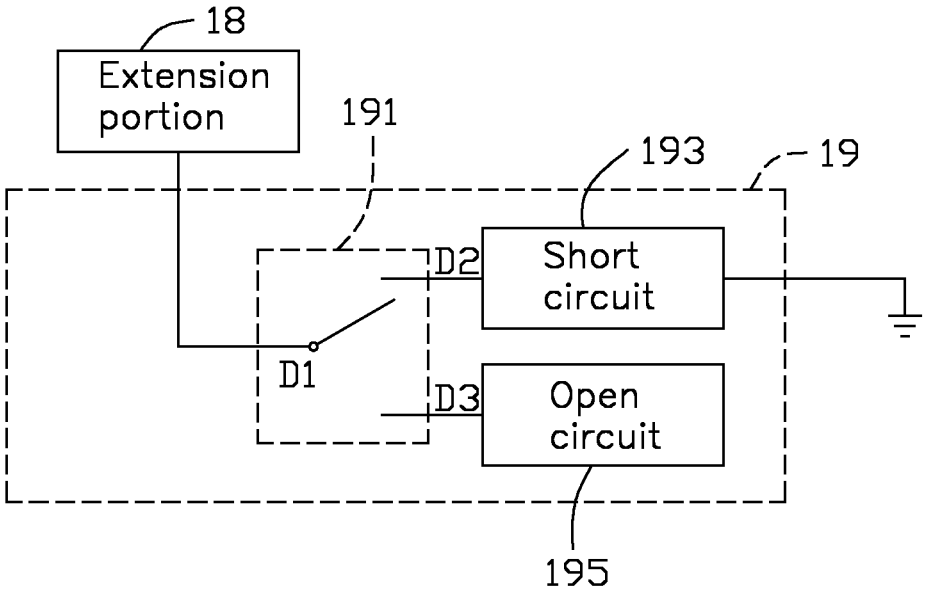
FIG. 2 is a circuit diagram of an extension portion and a switching unit of the antenna structure of FIG. 1.

As illustrated in FIG. 2, the antenna structure 100 further includes a switching unit 19. The switching unit 19 includes a switch 191, a short circuit 193, and an open circuit 195. In this exemplary embodiment, the switch 191 is a single pole double throw switch. The switch 191 includes a movable contact D1, a first stationary contact D2, and a second stationary contact D3. The movable contact D1 is electrically connected to the extension portion 18. The first stationary contact D2 is grounded through the short circuit 193. The second stationary contact D3 is electrically connected to the open circuit 195. Through controlling the switch 191, the extension portion 18 can be switched to connect with the short circuit 193 or the open circuit 195, thereby the antenna structure 100 works at corresponding frequency bands.

For example, when the switch 191 is switched to the short circuit 193, the extension portion 18 is at a short-circuit state. The extension portion 18 is grounded through the short circuit 193 and the antenna structure 100 works at a first frequency band. When the switch 191 is switched to the open circuit 195, the extension portion 18 is at an open-circuit state. The extension portion 18 is not grounded and the antenna structure 100 works at a second frequency band. In this exemplary embodiment, the frequency range of the first frequency band is about 880-960 MHz and the frequency range of the second frequency band is about 703-803 MHz.

Figure 3:
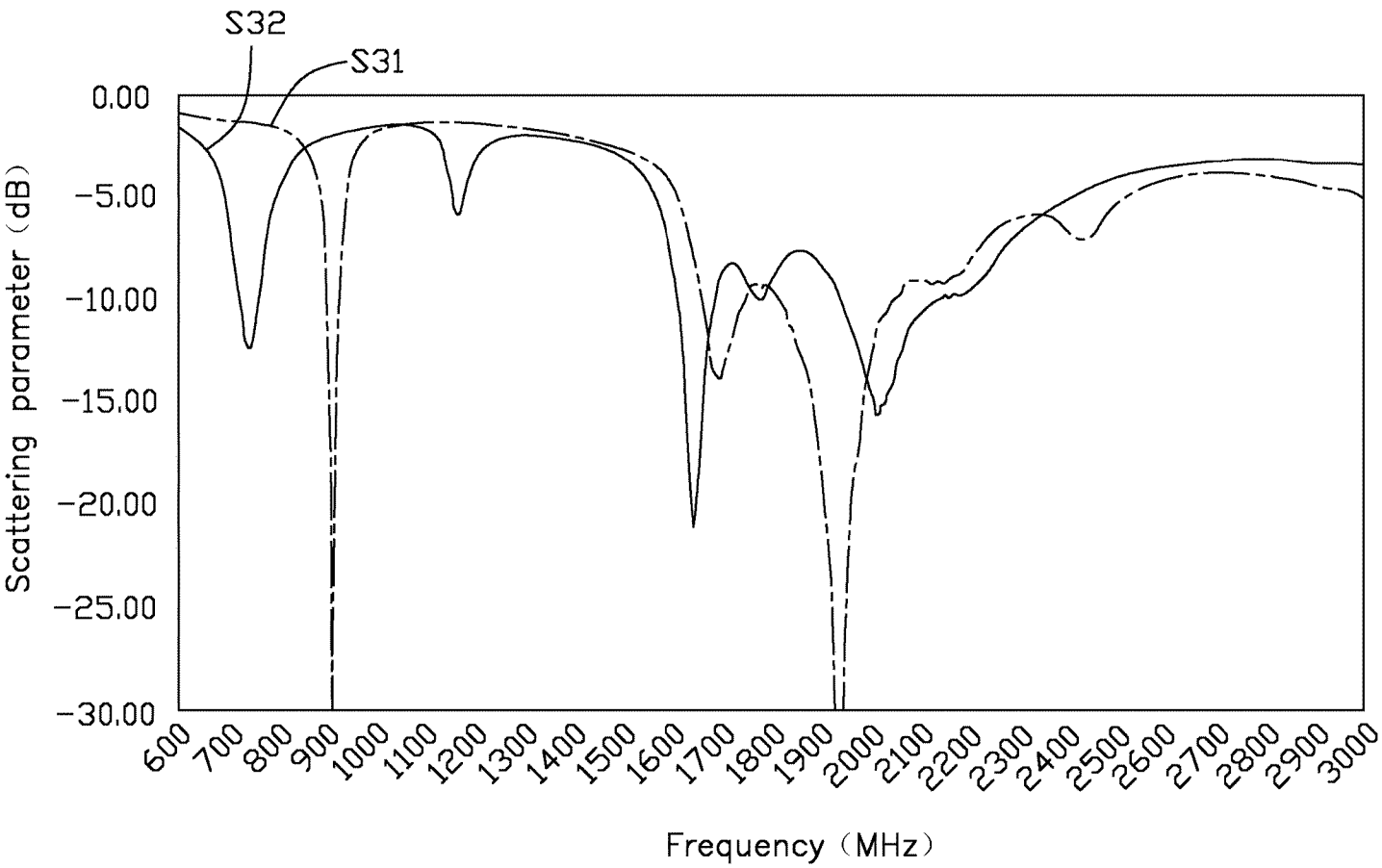
FIG. 3 is a scattering parameter graph of the antenna structure of FIG. 1.

FIG. 3 illustrates a scattering parameter graph of the antenna structure 100. Curve S31 illustrates a scattering parameter when the antenna structure 100 works at the first frequency band. Curve S32 illustrates a scattering parameter when the antenna structure 100 works at the second frequency band.

Figure 4:
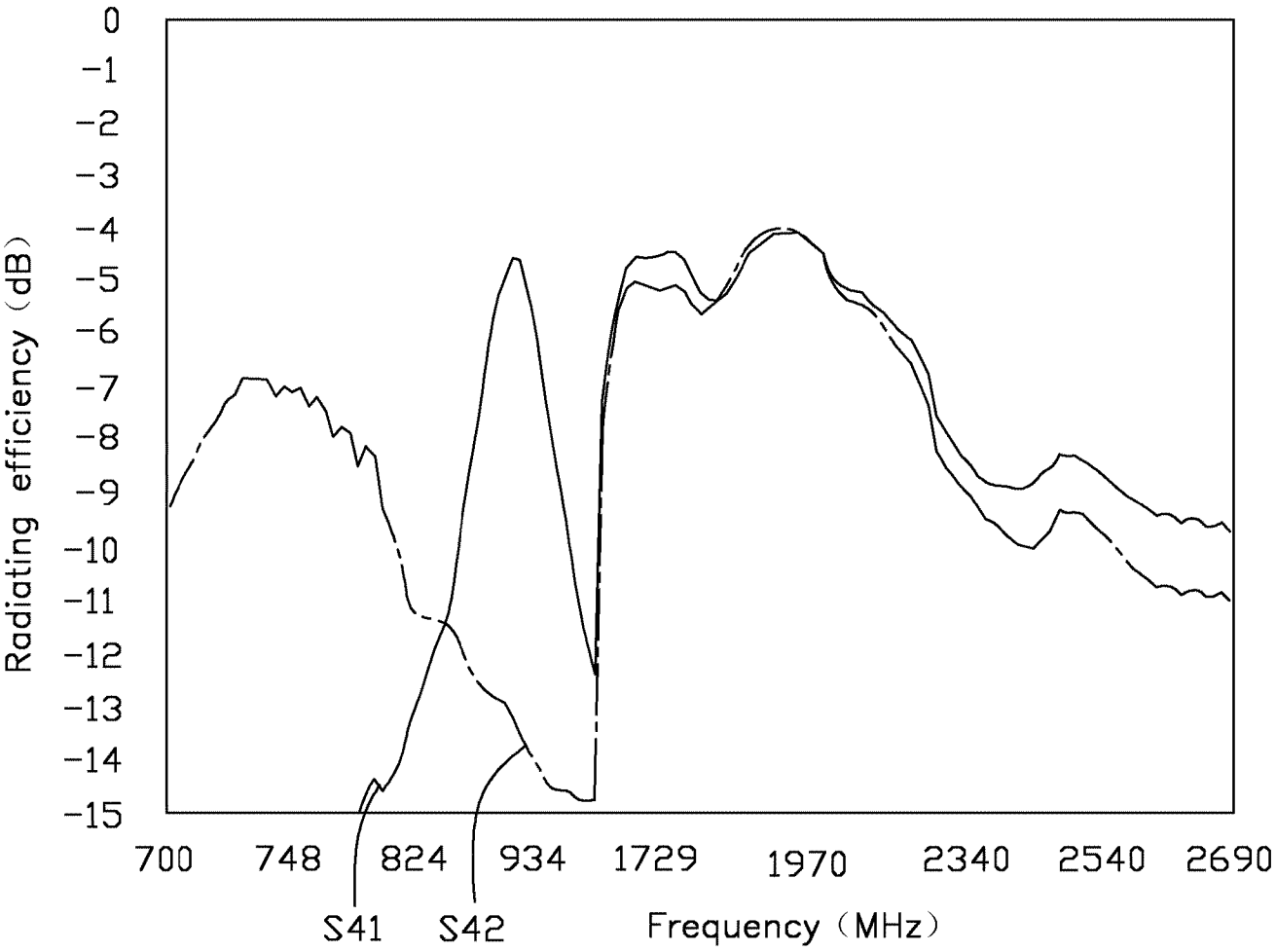
FIG. 4 is a radiating efficiency graph of the antenna structure of FIG. 1.

FIG. 4 illustrates a radiating efficiency graph of the antenna structure 100. Curve S41 illustrates a radiating efficiency when the antenna structure 100 works at the first frequency band. Curve S42 illustrates a radiating efficiency when the antenna structure 100 works at the second frequency band. In views of FIG. 3 and FIG. 4, when the antenna structure 100 works at frequency bands of 703-803 MHz and 880-960 MHz, a working frequency satisfies a design target of the antenna and also has a good radiating efficiency.

In other exemplary embodiments, an operating bandwidth of the antenna structure 100 in the high frequency band can be adjustable through adjusting a width of the first gap G1 between the ground portion 11 and the feed portion 13.

In other exemplary embodiments, through adjusting a width of the second gap G2 between the high-frequency resonance portion 15 and the high-frequency radiating portion 16 to activate an impedance bandwidth of corresponding working frequency bands, for example, a DCS/PCS/WCDMA band (i.e., a frequency band of about 1710-2170 MHz).

In summary, the antenna structure 100 includes the extension portion 18 and the switching unit 19. Through controlling the switching unit 19, the extension portion 18 can be controlled to be in the short-circuit or the open-circuit state, thereby enabling the antenna structure 100 to operate in a corresponding low frequency band, such as frequency bands of about 703-803 MHz and 880-960 MHz. In addition, the antenna structure 100 may operate at the frequency band of about 1710-2170 MHz. That is, the antenna structure 100 can be applied to GSM, WCDMA I/II/V/VIII, and LTE Band 1/3/8/28 bands.

The embodiments shown and described above are only examples. Many details are often found in the art such as the other features of the antenna structure. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a feed portion, the feed portion supplying a current signal;

a high-frequency radiating portion, the high-frequency radiating portion electrically connected to the feed portion;

a low-frequency radiating portion, the low-frequency radiating portion electrically connected to the high-frequency radiating portion;

an extension portion, the extension portion electrically connected to the feed portion and the high-frequency radiating portion; and a switching unit, the switching unit electrically connected to the extension portion to control the extension portion to be in one of an open-circuit state and a short-circuit state;

wherein the switching unit comprises a switch, a short circuit, and an open circuit, the switch comprises a movable contact, a first stationary contact, and a second stationary contact; wherein the movable contact is electrically connected to the extension portion, the first stationary contact is grounded through the short circuit, and the second stationary contact is electrically connected to the open circuit; wherein through controlling the switch, the extension portion is switched to connect with one of the short circuit and the open circuit so that the extension portion is in one of the open-circuit state and the short-circuit state.

2. The antenna structure of claim 1, wherein the feed portion, the high-frequency radiating portion, the low-frequency radiating portion, and the extension portion are coplanar with each other.

3. The antenna structure of claim 1, further comprising a ground portion, wherein the ground portion is spaced apart from and parallel to the feed portion, a first gap is defined between the ground portion and the feed portion; and wherein an operating bandwidth of the antenna structure in a high frequency band is adjustable through adjusting a width of the first gap.

4. The antenna structure of claim 3, further comprising a high-frequency resonance portion, wherein the high-frequency resonance portion is electrically connected to the ground portion, a second gap is defined between the ground portion and the high-frequency resonance portion, the second gap is in communication with the first gap; and wherein an impedance bandwidth of corresponding working frequency bands is activated through adjusting a width of the second gap.

5. The antenna structure of claim 4, wherein the high-frequency resonance portion comprises a first resonance section, a second resonance section, a third resonance section, a fourth resonance section, and a fifth resonance section; wherein the first resonance section is perpendicularly connected to one end of the ground portion and extends away from the feed portion; wherein the second resonance section is perpendicularly connected to an end of the first resonance section away from the ground portion and extends along a direction parallel to and away from the ground portion; wherein the third resonance section is perpendicularly connected to an end of the second resonance section away from the first resonance section and extends along a direction parallel to the first resonance section and away from the ground portion; wherein the fourth resonance section is perpendicularly connected to an end of the third resonance section away from the second resonance section and extends along a direction parallel to the second resonance section and away from the ground portion; wherein one end of the fifth resonance section is perpendicularly connected to a junction of the third resonance section and the fourth resonance section, another end of the fifth resonance section extends along a direction parallel to the second resonance section and away from the fourth resonance section, then extends along a direction parallel to the first resonance section and away from the ground portion.

6. The antenna structure of claim 5, wherein the high-frequency radiating portion comprises a first radiating section, a second radiating section, and a third radiating section; wherein the first radiating section is perpendicularly connected to the end of the feed portion adjacent to the first resonance section and extends along a direction parallel to the first resonance section towards the ground portion; wherein the second radiating section is perpendicularly connected to an end of the first radiating section away from the feed portion and extends along a direction parallel to the second resonance section and away from the feed portion; wherein the third radiating section is perpendicularly connected to an end of the second radiating section away from the first radiating section and extends along a direction parallel to the first resonance section and away from the feed portion.

7. The antenna structure of claim 6, wherein the low-frequency radiating portion comprises a first connecting section, a second connecting section, a third connecting section, a fourth connecting section, a fifth connecting section, a sixth connecting section, a seventh connecting section, an eighth connecting section, and a ninth connecting section; wherein the first connecting section is perpendicularly connected to a middle portion of the third radiating section and extends along a direction parallel to the ground portion and away from the high-frequency resonance portion; wherein the second connecting section is perpendicularly connected to an end of the first connecting section away from the third radiating section and extends along a direction parallel to the third radiating section and towards the feed portion until the second connecting section passes beyond the feed portion; wherein the third connecting section is perpendicularly connected to an end of the second connecting section away from the first connecting section and extends along a direction parallel to and towards the feed portion, then extends along a direction parallel to the second connecting section and away from the feed portion, and then extends along a direction parallel to the first connecting section and away from the feed portion; wherein the fourth connecting section is perpendicularly connected to an end of the third connecting section away from the second connecting section and extends along a direction parallel to the third radiating section and away from the feed portion; wherein the fifth connecting section is electrically connected to an end of the fourth connecting section away from the third connecting section; wherein the sixth connecting section is electrically connected to an end of the fifth connecting section away from the fourth connecting section and extends along a direction parallel to the third radiating section and away from the feed portion; wherein the seventh connecting section is electrically connected to an end of the sixth connecting section away from the fifth connecting section; wherein the eighth connecting section is electrically connected to an end of the seventh connecting section away from the sixth connecting section and extends along a direction parallel to the third radiating section and away from the feed portion; and wherein the ninth connecting section is perpendicularly connected to an end of the eighth connecting section away from the seventh connecting section.

8. The antenna structure of claim 7, wherein the first connecting section is a strip, the second connecting section is a strip, the third connecting section is U-shaped, the fourth connecting section is a strip, the fifth connecting section is arched, the sixth connecting section is a strip, the seventh connecting section is arched, the eighth connecting section is a strip, and the ninth connecting section is arced; wherein second connecting section, the fourth connecting section, the sixteen connecting section, and the eight connecting section are substantially at a same straight line; and wherein the first connecting section, the third connecting section, the fifth connecting section, the seventh connecting section, and the ninth connecting section are all positioned at a same side of the second connecting section, the fourth connecting section, the sixth connecting section, and the eight connecting section adjacent to the feed portion.

9. The antenna structure of claim 6, wherein the extension portion comprises a first extension section, a second extension section, a third extension section, a fourth extension section, a fifth extension section, and a sixth extension section; wherein the first extension section is perpendicularly connected to a junction of the feed portion and the first radiating section and extends along a direction parallel to the first resonance section and away from the ground portion and the feed portion; wherein the second extension section is electrically connected to an end of the first extension section away from the feed portion and extends along a direction parallel to the first resonance section and away from the ground portion and the feed portion; wherein the third extension section is perpendicularly connected to an end of the second extension section away from the first extension section and extends along a direction parallel to the feed portion and away from the low-frequency radiating portion; wherein the fourth extension section is perpendicularly connected to an end of the third extension section away from the second extension section and extends along a direction parallel to the second extension section and away from the ground portion and the feed portion; wherein the fifth extension section is perpendicularly connected to an end of the fourth extension section away from the third extension section and extends along a direction parallel to the feed portion and away from the low-frequency radiating portion; and wherein the sixth extension section is perpendicularly connected to an end of the fifth extension section away from the fourth extension section and extends along a direction parallel to the fourth extension section and away from the feed portion.

* * * * *